United States Patent [19]

Larsen

[11] Patent Number: 4,791,974

[45] Date of Patent: Dec. 20, 1988

[54] METHOD AND AN APPARATUS FOR PRODUCING SHAPED BODIES FROM PARTICULATE MATERIAL

[75] Inventor: Aage B. Larsen, Roskilde, Denmark

[73] Assignee: Dansk Industri Syndikat A/S, Herlev, Denmark

[21] Appl. No.: 50,385

[22] Filed: May 18, 1987

[51] Int. Cl.[4] ..... B22D 15/24

[52] U.S. Cl. ..... 164/7.1; 164/40; 164/160.1; 164/195

[58] Field of Search ..... 164/7.1, 160.1, 19, 164/20, 21, 22, 200, 201, 202, 40, 195

[56] References Cited

U.S. PATENT DOCUMENTS

| | | | |
|---|---|---|---|
| 2,882,565 | 4/1959 | Selby | 164/201 |
| 3,965,961 | 6/1976 | Gunnergaard | 164/200 |
| 4,182,395 | 1/1980 | Bühler | 164/160.1 |
| 4,593,740 | 6/1986 | Bühler | 164/44 |

*Primary Examiner*—Nicholas P. Godici

*Assistant Examiner*—Richard K. Seidel

*Attorney, Agent, or Firm*—Larson and Taylor

[57] ABSTRACT

In a method of operating an apparatus with a mold chamber (8) being supplied with fluidized mold sand (2) from a supply chamber (1) under air pressure applied through suitable air channels (3), and in which the pressure in the supply chamber (1) is increased gradually from a low to a high value to avoid turbulences in the initial filling stage and ensuing weak spots in the molded article, while at the same time achieving a short total filling time and a high degree of compaction during the final stage, the new feature is that vacuum is applied through air-permeable mold chamber walls (9,10), preferably before increasing the pressure in the supply chamber (1), thus avoiding the formation of air pockets in depressions in the mold chamber walls, that could otherwise cause reduced compactness and density in protruding parts of the shaped body (not shown) being formed in the mold chamber (8).

11 Claims, 2 Drawing Sheets

METHOD AND AN APPARATUS FOR PRODUCING SHAPED BODIES FROM PARTICULATE MATERIAL

TECHNICAL FIELD

This invention relates primarily to a method of producing a shaped body from particulate material, said method being of the type comprising the following steps a-c:

(a) providing a substantially closed mold chamber having an internal shape corresponding to the external shape of said body, (b) providing a supply chamber having an outlet connected in a substantially fluid-tight manner to an inlet of said mold chamber, (c) placing in said supply chamber a portion of said particulate material, and establishing and maintaining an increased air pressure in a region of said supply chamber having said portion of said particulate material between itself and said outlet, said pressure being gradually or stepwise increased during the major part of the period of transfer of said particulate material from said supply chamber into said mold chamber in dependence on a predetermined program.

BACKGROUND ART

A method of the type referred to above is known from U.S. Pat. Nos. 3,880,223 and 3,965,961 (Gunnergaard). This known method is adapted for the production of foundry mold parts to be used in assembling molds for casting molten metals, such as iron and alloys thereof. The method of the present invention is also mainly intended for such use, but may be applied in the production of other articles from particulate material without exceeding the scope of the present invention, the following explanation of which being, however, based upon the foundry application referred to.

Such a method has been shown capable of producing shaped bodies of considerably improved uniformity of compactness and density throughout their extent, as compared to bodies produced using earlier methods. Practical experience has, however, shown that the resulting bodies are not yet quite perfect with regard to this uniformity, as especially narrow protruding parts, corresponding to narrow depressions in the mold chamber walls, tend to exhibit reduced compactness and density. This tendency may be ascribed to the formation of pockets of air being compressed in depressed portions of the mold chamber walls during the initial stages of the mold-filling process.

DISCLOSURE OF THE INVENTION

It is an object of the present invention to provide a method of the type referred to initially, with which high-quality shaped bodies can be produced with improved uniformity throughout with regard to compactness and density.

According to the present invention, this object is achieved by (d) that a mold chamber is used having at least one air-permeable wall, and (e) that during a major part of the period of maintaining said increased pressure in said region, vacuum is applied to the outside of at least one air-permeable wall in said mold chamber.

By proceeding in this manner, the formation of air pockets in narrow depressions in the mold chamber walls is avoided, thus avoiding the formation in the shaped body of protruding parts with reduced compactness and density.

BRIEF DESCRIPTION OF THE DRAWING

In the following, the present invention will be explained in more detail with reference to the drawing, in which FIG. 1 diagramatically shows an apparatus for carrying pout the method according to the invention, pand FIG. 2, likewise diagrammatically, shows an example pof the variations in pressure and other functions pprovided by the apparatus of FIG. 1.

DESCRIPTION OF THE PREFERRED EMBODIMENT

Figure 1:
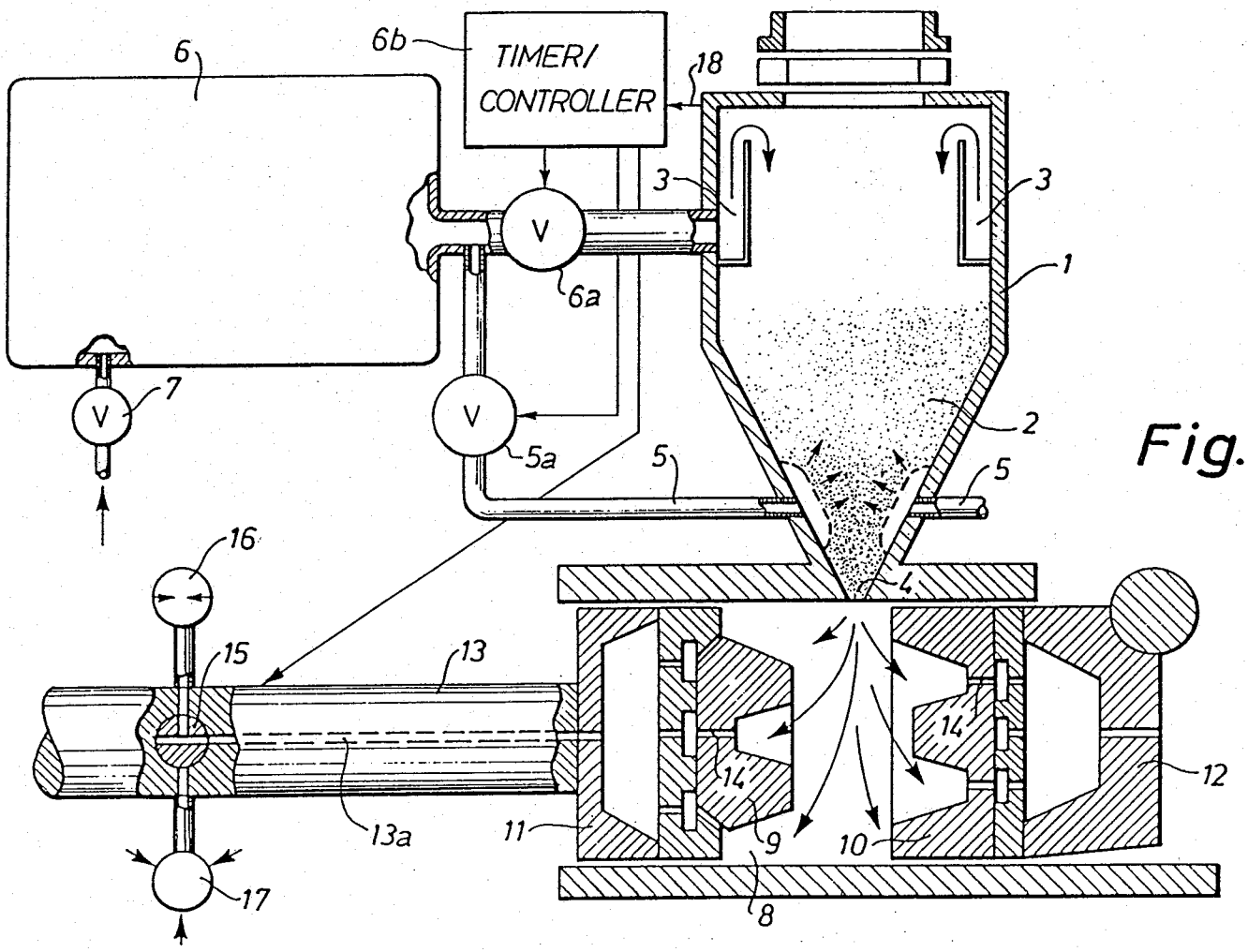

In the apparatus shown in FIG. 1, a supply chamber 1 is used for storing mold sand 2. During the actual molding operation, air under pressure is supplied to the space above the sand 2 through air channels 3, which are connected to a compressed-air tank 6 through a valve **6*a* adapted to be controlled by a timer/controller 6*b* in a manner to be explained in more detail below. An outlet 4 connects the lower part of the supply chamber 1 to a mold chamber 8** to be described in more detail below.

Immediately above the outlet 4 the lower part of the supply chamber 1 is provided with fluidization ducts 5, connected to the compressed-air tank 6 through a valve **5*a*, also adapted to be controlled by the timer/controller 6*b***.

When in operation, the top of the supply chamber 1 is connected to a sand supply container (not shown) in such a manner, that the air under pressure in the supply chamber 1 cannot escape in this direction.

The compressed-air tank 6 is provided with compressed air from a suitable source (not shown), connected to the tank through a valve 7.

Figure 2:
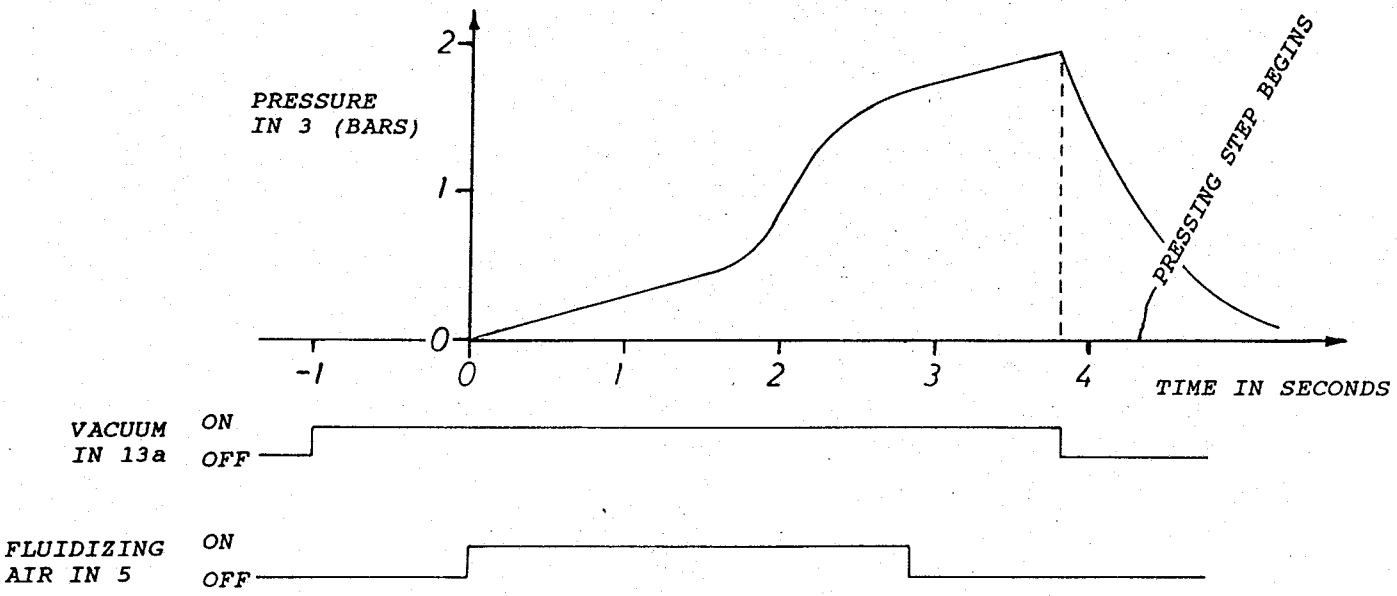

The mold chamber 8, situated as shown below the supply chamber 1, is limited in the lateral direction by pattern plates 9 and 10. The pattern plates are supported by squeeze plates 11 and 12 respectively. Mold chamber 8 is substantially closed except for openings for the escape of air used to transfer particulate material from the supply chamber into the mold chamber, as shown just above and below pattern plates 9 and 10 in FIG. 1. A piston arrangement 13, of which only one piston is shown, is adapted to move the two squeeze plates 11 and 12 and hence the two pattern plates 9 and 10 towards each other under high pressure. The pattern plates 9 and 10 comprise passages 14, which may be connected to either a vacuum source 16 or a pressure source 17 through a duct **13*a* and a three-way valve 15 accommodated in the piston arrangement 13, the valve 15 being controlled by the timer/controller 6*b*. In the position shown in FIG. 1, the injection of sand 2 from the supply chamber 1 into the mold chamber 8 has just begun, the pressure in the air channels 3 initially being kept comparatively low as shown in FIG. 2. Filling of cavities and parts with an intricate pattern on the molding surfaces of the pattern plates 9 and 10 is assisted by applying vacuum through the passages 14, the three-way valve 15 then being in the position shown in FIG. 1. This application of vacuum is preferably initiated already before applying pressure to the top of the supply chamber 1, such as approximately 1.0 second earlier as shown in FIG. 2. Transfer of sand 2 from the supply chamber 1 to the mold chamber 8 may be facilitated by supplying air under a suitable pressure through the fluidization ducts 5, thus causing the sand 2 in the lower part of the supply chamber 1 to be fluidized and hence to flow more easily into the mold chamber 8. The supply of fluidization air is preferably interrupted a short interval before the filling of the mold chamber 8 is completed, so as to avoid "dilution" of the last portion of sand entering the mold chamber 8**.

As the injection pressure as shown in FIG. 2 is low in the initial stages of the mold-filling operation, the velocity of the sand 2 and accompanying air flowing into the mold chamber 8 is moderate and hence unable to cause turbulences preventing the proper filling of deep or intricate parts of the molding surfaces of the pattern plates 9 and 10. At the same time, the vacuum already applied through the duct 13*a* has caused a reduction in the pressure in the passages 14 and the adjacent spaces in the mold chamber, thus preventing the formation of air pockets when the sand 2 suddenly rushes into the mold chamber. During later stages, however, the pressure is increased, causing a corresponding increase in velocity and hence a shortening of the time required for completely filling the mold chamber 8. The filling operation is terminated by closing the valve 6*a*, after which the pressure in the supply chamber 1 falls as indicated in FIG. 2 by exhaust through an exhaust valve (not shown) controlled by the timer/controller 6*b*.

At a suitable point in time, which may be before, at or after the closing of valve 6a, the squeeze plates 11 and 12 are moved towards each other by the piston arrangement 13, operated by a suitable hydraulic cylinder (not shown), so that the sand in the mold chamber 8 is compressed further to the desired degree of compactness.

The duct 13*a* and the passages 14 may subsequently be used for supplying air under pressure from the pressure source 17 in order to liberate the pattern plates 9 and 10 from the molded article (not shown), which article may suitably constitute a mold part to be used in an automatic foundry plant.

The timer/controller 6*b* may be constructed in any manner suitable to give the desired control of the pressure in the supply chamber 1, the supply of fluidization air through the ducts 5 and the application of vacuum through the duct 13*a* and the passages 14, as well as other operations performed by the equipment shown. As shown in FIG. 1, the timer/controller 6*b* is adapted to sense the pressure in the top of the supply chamber 1 by means of a sensing conduit 18, which may be a tube transmitting the pressure from the supply chamber 1 to a suitable pressure sensor in the unit 6*b*, or an electric cable connecting a pressure sensor (not shown) in the supply chamber 1 to suitable components in the unit 6*b*. The timer/controller 6*b* is, however, preferably a unit containing one or a number of microprocessors with suitable interface, input, output and monitoring equipment, so as to make it easier to achieve whichever pressure and vacuum functions of time and other control functions that are desired in each case, using open or closed loop control as required to obtain optimal results with each type of pattern plate.

I claim:

1. In a method of producing a shaped body from particulate material, said method comprising:

(a) providing a mold chamber having an internal shape corresponding to the external shape of said body and being substantially closed except for openings for the escape of air used in transfer step c below, (b) providing a supply chamber having an outlet connected in a substantially fluid-tight manner to an inlet of said mold chamber, (c) placing in said supply chamber a portion of said particulate material, and establishing and maintaining an increased air pressure in a region of said supply chamber having said portion of said particulate material between itself and said outlet to cause the transfer of said particulate material from said supply chamber into said mold chamber, said pressure being gradually or stepwise increased during the major part of the period of said transfer in dependence on a predetermined program, the improvement wherein said mold chamber has at least one air-permeable wall, and wherein said method further includes, during a major part of the period of maintaining said increased pressure in said region, applying vacuum to the outside of said at least one air-permeable wall in said mold chamber.

2. A method as claimed in claim 1, wherein said step of applying vacuum to the outside of at least one air-permeable wall in said mold chamber is initiated before the initiation of the step of establishing and maintaining an increased air pressure in said region of said supply chamber.

3. A method as claimed in claim 2, wherein said step of applying vacuum to the outside of at least one air-permeable wall in said mold chamber is terminated substantially simultaneously with the beginning of that phase of said pressure-establishing and maintaining step, in which the pressure decreases rapidly from a maximum.

4. A method as claimed in claim 1, wherein said step of applying vacuum to the outside of at least one air-permeable wall in said mold chamber is terminated substantially simultaneously with the beginning of that phase of said pressure-establishing and maintaining step, in which the pressure decreases rapidly from a maximum.

5. A method as claimed in claim 1 wherein said mold chamber comprises at least two pattern plates, wherein said method further comprises compressing said body of particulate material before removing same from said mold chamber, and wherein said step of applying vacuum to the outside of at least one air-permeable wall in said mold chamber is terminated after the initiation of said compressing step.

6. In apparatus for producing shaped bodies from particulate material comprising (a) a mold chamber having an internal shape corresponding to the bodies to be produced and being substantially closed except for openings for the escape of air, (b) a supply chamber for particulate material having an outlet connected in substantially fluid-tight manner to an inlet of said mold chamber, and (c) air-pressure establishing and maintaining means for establishing an increased air pressure in a region of said supply chamber distant from said outlet, said means being adapted to gradually or stepwise increase said pressure during the major part of the period of transfer of said particulate material from said supply chamber to said mold chamber in dependence on a predetermined program, the improvement wherein said mold chamber comprises at least one air-permeable wall, and wherein said apparatus comprises means controlled in dependence of said predetermined program for applying vacuum to the outside of at least one air-permeable wall in said mold chamber during a major part of the period of maintaining said increased pressure in said supply-chamber region.

7. An apparatus as claimed in claim 6, wherein said means for applying vacuum to the outside of at least one air-permeable wall in said mold chamber is adapted to initiate said application of vacuum before the initiation of the step of establishing and maintaining an increased air pressure in said supply-chamber region.

8. An apparatus as claimed in claim 6, wherein said means for applying vacuum to the outside of at least one air-permeable wall in said mold chamber is adapted to terminate said application of vacuum substantially simultaneously with the beginning of that phase of said pressure-establishing and maintaining step, in which the pressure decreases rapidly from a maximum.

9. An apparatus as claimed in claim 6, wherein said means is adapted to terminate said fluidizing step before the termination of said pressure-establishing and maintaining step.

10. An apparatus as claimed in claim 6, wherein said mold chamber comprises at least two pattern plates, wherein said apparatus further comprises means for moving two mold pattern plates towards each other for compressing the body of particulate material being formed therein, and wherein said means for applying vacuum to the outside of at least one air-permeable wall in said mold chamber is controlled by said predetermined program to continue said vacuum-application step beyond the initiation of said compressing step.

11. An apparatus as claimed in claim 6, wherein said means to supply air under pressure to the outside of at least one air-permeable wall and said means to apply vacuum comprise common means, including at least one duct, one end of which communicates with said outside space and the other end of which communicates with a three-way valve selectively communicating said duct with a source of pressurized air or a source of vacuum respectively.

* * * * *